US005860040A

United States Patent [19]

Shimizu et al.

[11] Patent Number: 5,860,040

[45] Date of Patent: Jan. 12, 1999

[54] DEVELOPING APPARATUS HAVING STOP PERIOD DURING WHICH NO AC ELECTRIC FIELD IS EXERTED BETWEEN DEVELOPER CARRYING MEMBER AND IMAGE CARRYING MEMBER

[75] Inventors: Tamotsu Shimizu, Osaka; Yoshiyuki Iguchi, Takarazuka; Yoshio Sakagawa, Ibaraki, all of Japan

[73] Assignee: Minolta Co., Ltd., Osaka, Japan

[21] Appl. No.: 921,339

[22] Filed: Aug. 29, 1997

[30] Foreign Application Priority Data

| | | | |
|---|---|---|---|
| Sep. 3, 1996 | [JP] | Japan | 8-253791 |
| Sep. 3, 1996 | [JP] | Japan | 8-253792 |
| Sep. 20, 1996 | [JP] | Japan | 8-271462 |
| Jan. 24, 1997 | [JP] | Japan | 9-010977 |
| Jan. 24, 1997 | [JP] | Japan | 9-010978 |

[51] Int. Cl.[6] ..... G03G 15/06; G03G 15/08

[52] U.S. Cl. ..... 399/55; 399/285

[58] Field of Search ..... 399/55, 270, 285, 399/235, 240

[56] References Cited

U.S. PATENT DOCUMENTS

| | | | |
|---|---|---|---|
| 4,611,531 | 9/1986 | Hayashi et al. . | |
| 4,688,923 | 8/1987 | Kohyama et al. . | |
| 5,187,523 | 2/1993 | Osawa | 399/270 |
| 5,202,731 | 4/1993 | Tanikawa et al. | 399/270 |
| 5,338,894 | 8/1994 | Uchiyama et al. | 399/270 |
| 5,463,452 | 10/1995 | Inaba et al. | 399/270 |
| 5,610,696 | 3/1997 | Kemmochi et al. | 399/285 |
| 5,752,140 | 5/1998 | Danzuka et al. | 399/270 |

*Primary Examiner*—S. Lee

*Attorney, Agent, or Firm*—McDermott, Will & Emery

[57] ABSTRACT

A developing apparatus is so adapted that in performing development upon converting a developer to a developing area opposite to an image carrying member by a developer carrying member with the developer held on the surface of the developer carrying member as well as alternately repeating an exertion period during which an AC electric field is exerted between the developer carrying member and the image carrying member and a stop period during which no AC electric field is exerted, the AC electric field is exerted in such a manner that the directions of the first and last electric field portions of the AC electric field in one exertion period are the same, and the direction of the last electric field portion of the AC electric field in the exertion period and the direction of the first electric field portion of the AC electric field in the subsequent exertion period after an elapse of the stop period are the same.

25 Claims, 10 Drawing Sheets

DEVELOPING APPARATUS HAVING STOP PERIOD DURING WHICH NO AC ELECTRIC FIELD IS EXERTED BETWEEN DEVELOPER CARRYING MEMBER AND IMAGE CARRYING MEMBER

BACKGROUND OF THE INVENTION

1. Field of the Invention

The present invention relates generally to a developing apparatus used for developing an electrostatic latent image formed on an image carrying member in an image forming apparatus such as a copying machine or a printer, and more particularly, to a developing apparatus for performing development upon conveying a developer to a developing area opposite to an image carrying member by a developer carrying member with the developer held on the surface of the developer carrying member as well as exerting an AC electric field between the developer carrying member and the image carrying member, which is characterized in that the conditions under which the AC electric field is exerted is suitably set, to obtain an image having a sufficient image density and being fine in texture.

2. Description of the Related Art

Conventionally, in an image forming apparatus such as a copying machine or a printer, various developing apparatuses have been employed in order to develop an electrostatic latent image formed on an image carrying member.

One example of such a developing apparatus is a developing apparatus as shown in FIG. 1. In the developing apparatus, a cylindrical developer carrying member 11 having a magnet roller 11*a* provided on its inner periphery is provided in the main body 10 of the apparatus so as to be opposite to an image carrying member 1, so that a developer 2 contained in the main body 10 of the apparatus is supplied to the surface of the developer carrying member 11 by a developer supplying member 12 such as a bucket roller. The developer 2 is held on the surface of the developer carrying member 11 by the magnetic force of the magnet roller 11*a*, the developer carrying member 11 is rotated to convey the developer 2, and the amount of the developer 2 conveyed to a developing area where the developer carrying member 11 and the image carrying member 1 are opposite to each other is controlled by a controlling member 13, after which the developer 2 is introduced into the developing area to develop an electrostatic latent image formed on the image carrying member 1.

In order to efficiently develop the electrostatic latent image formed on the image carrying member 1 as well as to prevent a toner image formed on the image carrying member 1 from being scrapped by a magnetic brush formed of the developer 2 in the above-mentioned developing apparatus, a developing apparatus so adapted as to perform development upon respectively applying a DC voltage and an AC voltage in a superimposed state to a developer carrying member 11 from a DC power supply 14 and an AC power supply 15 and exerting an electric field obtained by superimposing an AC electric field on an DC electric field on a developing area where the developer carrying member 11 and the image carrying member 1 are opposite to each other, as shown in FIG. 1, has been developed.

When development is thus performed upon exerting the electric field obtained by superimposing the AC electric field on the DC electric field on the developing area where the developer carrying member 11 and the image carrying member 1 are opposite to each other, to obtain a halftone image, however, the change in the density of the halftone image corresponding to the change in a surface potential of the image carrying member 1 corresponding to the halftone image is large in a part of the surface potential. Therefore, no good halftone image is obtained, and the texture of the formed image is not sufficient.

Therefore, in recent years, a developing apparatus so adapted as to perform development in such a manner that a first period (an exertion period) during which an AC electric field is formed between a developer carrying member and an image carrying member and a second period (a stop period) during which the formation of an AC electric field is stopped are alternately repeated, a pair of electric field components of the AC electric field which are opposite in direction are exerted in the first period, and the final electric field component of the AC electric field is always an electric field component for returning a developer to the developer carrying member has been proposed, as disclosed in Japanese Patent Publication No. 14706/1990 (U.S. Pat. No. 4,610,531).

In a case where the pair of electric field components of the AC electric field which are opposite in direction is exerted in the first period, and the final electric field component of the AC electric field is always the electric field component for returning the developer to the developer carrying member, however, the AC electric field is always stopped in a state where the developer is returned from the image carrying member to the developer carrying member while being moved between the image carrying member and the developer carrying member, after which the second period is started. Also in the second period, the developer is continuously returned to the developer carrying member. When development is performed in the above-mentioned manner, therefore, the developer is not sufficiently supplied to the image carrying member, so that the image density of a formed image is decreased. When development is performed at high speed, no image having a sufficient image density is obtained, and the texture of the formed image cannot be improved.

SUMMARY OF THE INVENTION

An object of the present invention is to obtain a good halftone image in a developing apparatus for performing development upon exerting an AC electric field between a developer carrying member and an image carrying member as described above.

Another object of the present invention is to obtain an image having a sufficient image density as well as to stably obtain an image of fine texture in the above-mentioned developing apparatus.

Still another object of the present invention is to prevent a formed image from being fogged in the above-mentioned developing apparatus.

A further object of the present invention is to prevent carrier particles from adhering on an image carrying member in the above-mentioned developing apparatus.

In a developing apparatus for performing development upon conveying a developer to a developing area opposite to an image carrying member by a developer carrying member with the developer held on the surface of the developer carrying member as well as alternately repeating an exertion period during which an AC electric field is exerted between the developer carrying member and the image carrying member and a stop period during which no AC electric field is exerted, a first developing apparatus in the present invention is characterized in that the AC electric field is exerted in such a manner that the directions of the first and last electric field portions of the AC electric field in one exertion period are the same, and the direction of the last electric field portion of the AC electric field in the exertion period and the direction of the first electric field portion of the AC electric field in the subsequent exertion period after an elapse of the stop period are the same.

According to the construction of the first developing apparatus, toner particles in the developer exist in a fine powder cloud state in a wide range between the image carrying member and the developer carrying member, the toner particles in a find power cloud state in the wide range is sufficiently supplied to the image carrying member by the exertion of the AC electric field. Therefore, a good halftone image is obtained, and an image of fine texture is obtained.

Particularly when the directions of the first and last electric field portions of the AC electric field in the exertion period are directions in which the developer is fed to the image carrying member, the toner particles in the developer exist in a powder cloud state in a position near the image carrying member, the toner particles in a powder cloud state are supplied to the image carrying member by the exertion of the AC electric field to perform development. Therefore, an image of finer texture is obtained.

In the first developing apparatus, if the exertion period is too short, a period during which development is performed upon exertion of the AC electric field is shortened, so that no image having a sufficient image density is obtained. On the other hand, if the exertion period is too long, the change in the image density corresponding to the change in the surface potential is increased, so that no good halftone image is obtained, and the texture of a formed image is roughened, as in a case where development is performed upon always exerting the AC electric field. Letting T be the exertion period, and t be the stop period, therefore, it is preferable to satisfy the conditions of $0.20 \leqq T/(T+t) \leqq 0.90$.

In a developing apparatus for performing development upon conveying a developer to a developing area opposite to an image carrying member by a developer carrying member with the developer held on the surface of the developer carrying member as well as alternately repeating an exertion period during which an AC electric field is exerted between the developer carrying member and the image carrying member and a stop period during which no AC electric field is exerted, a second developing apparatus in the present invention is characterized in that the AC electric field is exerted in such a manner that the directions of the first and last electric field portions of the AC electric field in one exertion period are the same, and the direction of the last electric field portion of the AC electric field in the exertion period and the direction of the first electric field portion of the AC electric field in the subsequent exertion period after an elapse of the stop period are opposite to each other.

According to the construction of the second developing apparatus, the directions of the electric field portions before and after the stop period are opposite to each other, and the direction of the last electric field portion of the AC electric field in the exertion period is changed for each stop period, so that the AC electric field is not exerted in a state where the developer is returned to the developer carrying member, and the AC electric field is not exerted in a state where the developer is sent to the image carrying member.

In the second developing apparatus, therefore, there are no possibilities that the AC electric field is not always exerted in a state where the developer is recovered in the developer carrying member, so that the density of a formed image is decreased, while the AC electric field is not always exerted in a state where the developer is sent to the image carrying member, so that the formed image is fogged by the supply of the excessive developer to the image carrying member, as in the conventional developing apparatus. Therefore, an image having a suitable image density is obtained, and an image also superior in halftone reproduction is obtained.

In a developing apparatus for performing development upon conveying a developer to a developing area opposite to an image carrying member by a developer carrying member with the developer held on the surface of the developer carrying member as well as exerting an AC electric field between the developer carrying member and the image carrying member, a third developing apparatus in the present invention is characterized in that there is provided a stop period during which no AC electric field is exerted every time the direction of the electric field portion of the AC electric field is changed.

Also in the third developing apparatus, the directions of the electric field portions before and after the stop period are opposite to each other, and the direction of the electric field portion before the stop period is changed for each stop period. Therefore, an image which is not fogged and has a suitable image density is obtained, and an image also superior in halftone reproduction is obtained, as in the first developing apparatus.

In each of the second and third developing apparatuses according to the present invention, if the period during which an AC electric field is exerted is too short, a period during which development is performed upon exertion of the AC electric field is shortened, so that no image having a sufficient image density is obtained. On the other hand, if the period during which an AC electric field is exerted is too long, the change in the image density corresponding to the change in the surface potential is increased, so that no good halftone image is obtained, and the texture of the formed image is roughened, as in a case where development is performed upon always exerting the AC electric field. Letting T be the period during which an AC electric field is exerted, and t be the stop period, therefore, it is preferable to satisfy the conditions of $0.20 \leqq T/(T+t) \leqq 0.90$.

In a developing apparatus for performing development upon conveying a developer to a developing area opposite to an image carrying member by a developer carrying member with the developer held on the surface of the developer carrying member as well as alternately repeating an exertion period during which an AC electric field is exerted between the developer carrying member and the image carrying member and a stop period during which no AC electric field is exerted, a fourth developing apparatus in the present invention is characterized in that the AC electric field is exerted in such a manner that the directions of the first and last electric field portions of the AC electric field in one exertion period are opposite to each other, and the direction of the last electric field portion of the AC electric field in the exertion period and the direction of the first electric field portion of the AC electric field in the subsequent exertion period after an elapse of the stop period are the same, and the length of one exertion period is not less than two-thirds the length of one stop period.

According to the construction of the fourth developing apparatus, the directions of the electric field portions before and after one stop period and the directions of the electric field portions before and after the subsequent stop period are opposite to each other, and the direction of the last electric field portion of the AC electric field in the exertion period is changed for each stop period, so that the AC electric field is not exerted in a state where the developer is returned to the developer carrying member, and the AC electric field is not exerted in a state where the developer is sent to the image carrying member.

In the fourth developing apparatus, therefore, there are no possibilities that the AC electric field is not always exerted in a state where the developer is recovered in the developer carrying member, so that the density of a formed image is decreased, while the AC electric field is not always exerted in a state where the developer is sent to the image carrying member, so that the formed image is fogged by the supply of the excessive developer to the image carrying member, as in the conventional developing apparatus. Further, the length of the exertion period is set to not less than two-thirds the length of the stop period, whereby a period during which development is performed upon exertion of the AC electric field is lengthened. Therefore, an image having a suitable image density is obtained, and an image also superior in halftone reproduction is obtained.

Furthermore, in the developing apparatus according to the present invention, when the stop period is started in a state where the direction of the last electric field portion of the AC electric field in the exertion period is the direction in which the developer is sent to the image carrying member, the developer in a powder cloud state is sent to the image carrying member by the function of the AC electric field in the exertion period, so that the developer enters a powder cloud state in its position on the side of the image carrying member. In the exertion period after an elapse of the stop period, the direction of the first electric field portion of the AC electric field is the same as the direction of the last electric field portion of the AC electric field in the previous exertion period, that is, the direction in which the developer is sent to the image carrying member, so that the developer in a powder cloud state in the position on the side of the image carrying member is supplied to the image carrying member, so that an image of fine texture is obtained.

In the above-mentioned first and fourth developing apparatuses, the amount of the developer conveyed to the developing area by the developer carrying member is preferably 0.5 to 10 mg/cm$^2$, and more preferably 1 to 7 mg/cm$^2$. If the amount of the developer conveyed is less than 0.5 mg/cm$^2$, toner particles are not sufficiently supplied to the image carrying member, so that the image density is decreased. On the other hand, if the amount of the developer conveyed is more than 10 mg/cm$^2$, the thickness of the developer on the surface of the developer carrying member is increased, whereby counter charge is easily left on carrier particles, and the carrier particles easily adhere to the image carrying member after the development. In each of the developing apparatuses, letting Ds be the distance between the developer carrying member and the image carrying member in the developing area, and Vpp be the peak-to-peak value of the AC voltage applied, it is preferable that a vibrating electric field in the range indicated by the following equation (1) is exerted:

$$5\ \text{KV/mm} \geqq \text{Vpp/Ds} \geqq 3.5\ \text{KV/mm} \quad (1)$$

If Vpp/Ds is less than 3.5 KV/mm, the movement of the charge on the carrier particles after the development is decreased, so that the carrier particles easily adhere to the image carrying member. If it is more than 5 KV/mm, a leak easily occurs between the developer carrying member and the image carrying member. In this case, the preferable range of Ds is 0.1 to 0.5 mm.

In each of the above-mentioned developing apparatuses, a mono-component magnetic developer and a two-component developer can be used as the developer. It is preferable to use the two-component developer. Particularly it is preferable that carrier particles having a volume-average particle diameter of 20 to 50 $\mu$m and preferably 25 to 45 $\mu$m are used as the carrier particles from the viewpoint of prevention of non-uniformity in density and adhesion of carrier particles. As the carrier particles, binder-type carrier particles having magnetic fine particles dispersed in binder resin and coat carrier particles having magnetic core particles surface coated with resin are suitably used. As the toner particles, toner particles having a volume-average particle diameter of 3 to 12 $\mu$m and preferably 4 to 9 $\mu$m are used.

There and other objects, advantages and features of the invention will become apparent from the following description thereof taken in connection with the accompanying drawings which illustrate specific embodiment of the invention.

DESCRIPTION OF THE PREFERRED EMBODIMENTS

Developing apparatuses according to preferred embodiments of the present invention will be specifically described on the basis of accompanying drawings.

Figure 1:
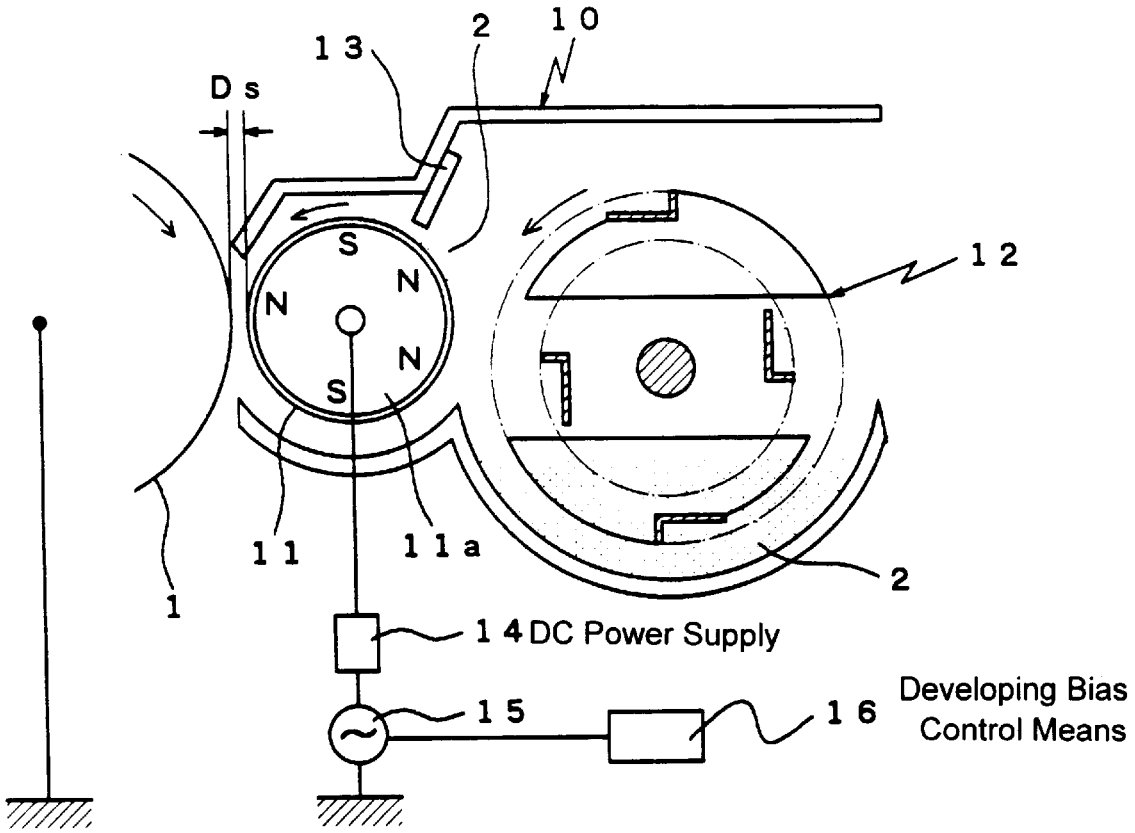
FIG. 1 is a schematic illustration of a developing apparatus.

Also in a developing apparatus in the embodiment of the present invention, a cylindrical developer carrying member 11 having a magnet roller 11*a* provided on its inner periphery is provided in the main body 10 of the apparatus so as to be opposite to an image carrying member 1, a developer 2 contained in the main body 10 of the apparatus is supplied to the surface of the developer carrying member 11 by a developer supplying member 12 such as a bucket roller, the developer 2 is held on the surface of the developer carrying member 11 by the magnetic force of the magnet roller 11*a*, the developer 2 is conveyed by the rotation of the developer carrying member 11 in this state, and the amount of the developer 2 conveyed to a developing area where the developer carrying member 11 and the image carrying member 1 are opposite to each other is controlled by a controlling member 13, after which the developer 2 is introduced into the developing area to develop an electrostatic latent image formed on the image carrying member 1, as in the above-mentioned developing apparatus shown in FIG. 1.

Also in the developing apparatus in the present embodiment, a voltage obtained by superimposing an AC voltage on a DC voltage is applied to the developer carrying member 11 from a DC power supply 14 and an AC power supply 15, and an electric field obtained by superimposing an AC electric field on a DC electric field is exerted on the developing area where the developer carrying member 11 and the image carrying member 1 are opposite to each other, to perform development.

In performing development in each of developing apparatuses according to first to fourth embodiments described below, an example of a developer is one obtained by so mixing binder-type carrier particles having a volume-average particle diameter of 35 μm and toner particles having a volume-average particle diameter of 8 μm that the toner density is 13% by weight.

In charging the image carrying member 1, the image carrying member 1 is so charged that its initial surface potential (Vo) is −450 V. The distance Ds between the image carrying member 1 and the developer carrying member 11 in the developing area is set to 0.35 mm, the system speed of the developing apparatus is set to 165 mm/s, the ratio θ (=v2/v1) of the rotational speed (v2) of the developer carrying member 11 to the rotational speed (v1) of the image carrying member 1 is set to 1.8, and the amount of the developer conveyed by the developer carrying member 11 is set to 4.8 mg/cm2. A DC voltage (Vd) of −350 V is applied from the DC power supply 14, and AC voltages having a peak-to-peak value (Vpp) of 1.6 kV and having different waveforms are applied from the AC power supply 15, to exert an electric field obtained by superimposing an AC electric field on a DC electric field.

First Embodiment

In a developing apparatus according to the first embodiment, in respectively applying a voltage obtained by superimposing an AC voltage on a DC voltage to the developer carrying member 11 from the DC power supply 14 and the AC power supply 15, to exert an electric field obtained by superimposing an AC electric field on a DC electric field on the developing area where the developer carrying member 11 and the image carrying member 1 are opposite to each other, an exertion period T during which an AC electric field is exerted and a stop period t during which no AC electric field is exerted are alternately repeated by developing bias control means 16, and the AC electric field is exerted in such a manner that the directions of the first and last electric field portions of the AC electric field in one exertion period T are the same, and the direction of the last electric field portion of the AC electric field in the exertion period T and the direction of the first electric field portion of the AC electric field in the subsequent exertion period T after an elapse of the stop period t are the same.

Developing apparatuses in examples 1 to 3 and comparative examples 1 and 2 in which the AC electric field exerted on the developing area where the developer carrying member 11 and the image carrying member 1 are opposite to each other is changed in the developing apparatus according to the first embodiment are then compared with each other, to make it clear that an image having a sufficient image density and being fine in texture is obtained if development is performed using the developing apparatuses in the examples 1 to 3.

Figure 2:
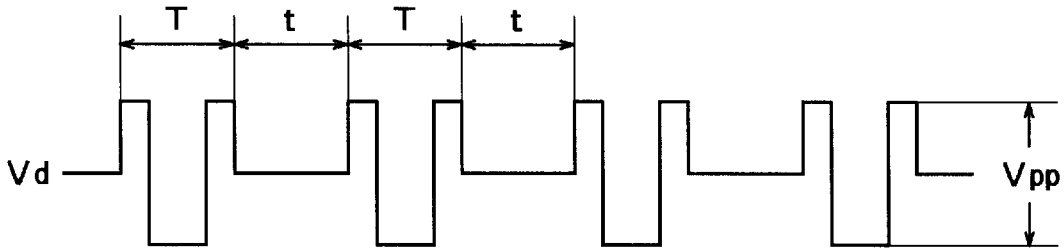
FIG. 2 is a diagram showing the state of an AC voltage applied to a developer carrying member from an AC power supply in a developing apparatus in an example 1 of the present invention.

In the example 1, in applying the AC voltage from the AC power supply 15, pulse voltages which have a pulse width of 0.08 ms and are the same in polarity are applied to the first and last electric field portions of the AC electric field in one exertion period T in such a manner that the directions of the first and last electric field portions are the same, that is, the direction in which the developer is sent to the image carrying member 1, while a pulse voltage which has a pulse width of 0.16 ms and is opposite in polarity to the first and last pulse voltages is applied to the second electric field portion therebetween, after which a stop period t of 0.33 ms during which no AC electric field is exerted is provided, and entirely the same AC voltage as that in the one exertion period T is also applied in the subsequent exertion period T after the stop period t, as shown in FIG. 2. The AC electric field is exerted upon successively repeating the exertion period T and the stop period t.

Figure 3:
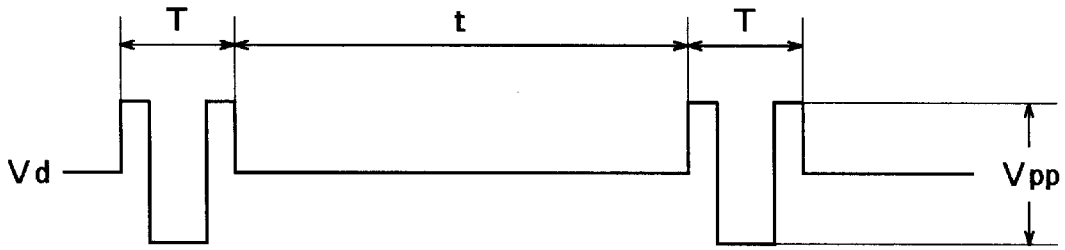
FIG. 3 is a diagram showing the state of an AC voltage applied to a developer carrying member from an AC power supply in a developing apparatus in an example 2 of the present invention.

In the example 2, the same AC voltage as that in the above-mentioned example 1 is applied in the exertion period T, while a stop period t of 1.333 ms during which no AC electric field is exerted is provided, as shown in FIG. 3. The AC electric field is exerted upon successively repeating the exertion period T and the stop period t.

Figure 4:
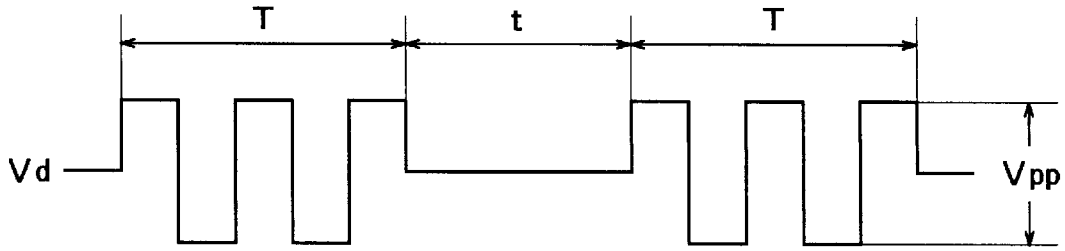
FIG. 4 is a diagram showing the state of an AC voltage applied to a developer carrying member from an AC power supply in a developing apparatus in an example 3 of the present invention.

In the example 3, five pulse voltages having a pulse width of 0.16 ms are so applied that their polarities are alternately changed in one exertion period T, so that the directions of the first and last electric field portions of the AC electric field in the exertion period T are the same, that is, the direction in which the developer is sent to the image carrying member 1, as in the above-mentioned examples 1 and 2, after which a stop period t of 0.67 ms during which no AC electric field is exerted is provided, and entirely the same AC voltage as that in the one exertion period T is also applied in the subsequent exertion period T after the stop period t, as shown in FIG. 4. The AC electric field is exerted upon successively repeating the exertion period T and the stop period t.

Figure 5:
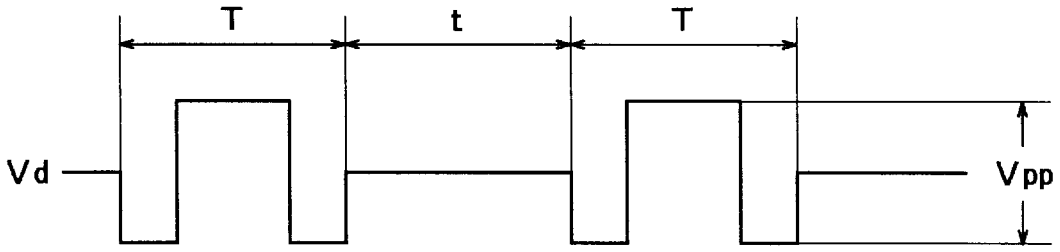
FIG. 5 is a diagram showing the state of an AC voltage applied to a developer carrying member from an AC power supply in a developing apparatus in an example 4 of the present invention.

In the example 4, pulse voltages which have a pulse width of 0.16 ms and are the same in polarity are respectively applied to the first and the last, i.e., third electric field portions of the AC electric field in one exertion period T in such a manner that the directions of the first and last electric field portions are the same, that is, the direction in which the developer is returned to the developer carrying member 11, while a pulse voltage, in the direction in which the developer is sent to the image carrying member 1, which has a pulse width of 0.33 ms and is opposite in polarity to the first and last pulse voltages is applied to the second electric field portion therebetween, after which a stop period t of 0.67 ms during which no AC electric field is exerted is provided, and entirely the same AC voltage as that in the one exertion period T is also applied in the subsequent exertion period T after the stop period t, as shown in FIG. 5. The AC electric field is exerted upon successively repeating the exertion period T and the stop period t.

Figure 6:
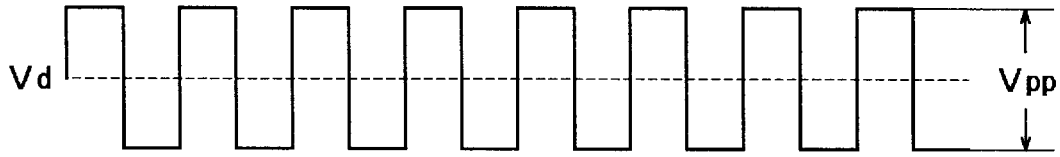
FIG. 6 is a diagram showing the state of an AC voltage applied to a developer carrying member from an AC power supply in developing apparatuses in comparative examples 1, 3 and 6.

On the other hand, in the comparative example 1, an AC voltage having a pulse width of 0.16 ms is continuously applied, as shown in FIG. 6.

Figure 7:
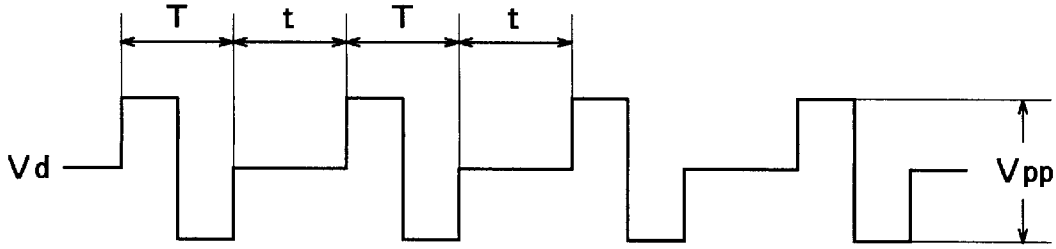
FIG. 7 is a diagram showing the state of an AC voltage applied to a developer carrying member from an AC power supply in developing apparatuses in comparative examples 2, 5 and 8.

In the comparative example 2, a pair of voltages which have a pulse width of 0.16 ms and are opposite in polarity is applied in one exertion period T, after which a stop period t of 0.33 ms during which no AC electric field is exerted is provided, so that the direction of an electric field portion exerted by the voltage before the stop period t is always the direction in which the developer is returned to the developer carrying member 11, as shown in FIG. 7. The AC electric field is exerted upon successively repeating the exertion period T and the stop period t.

Figure 8:
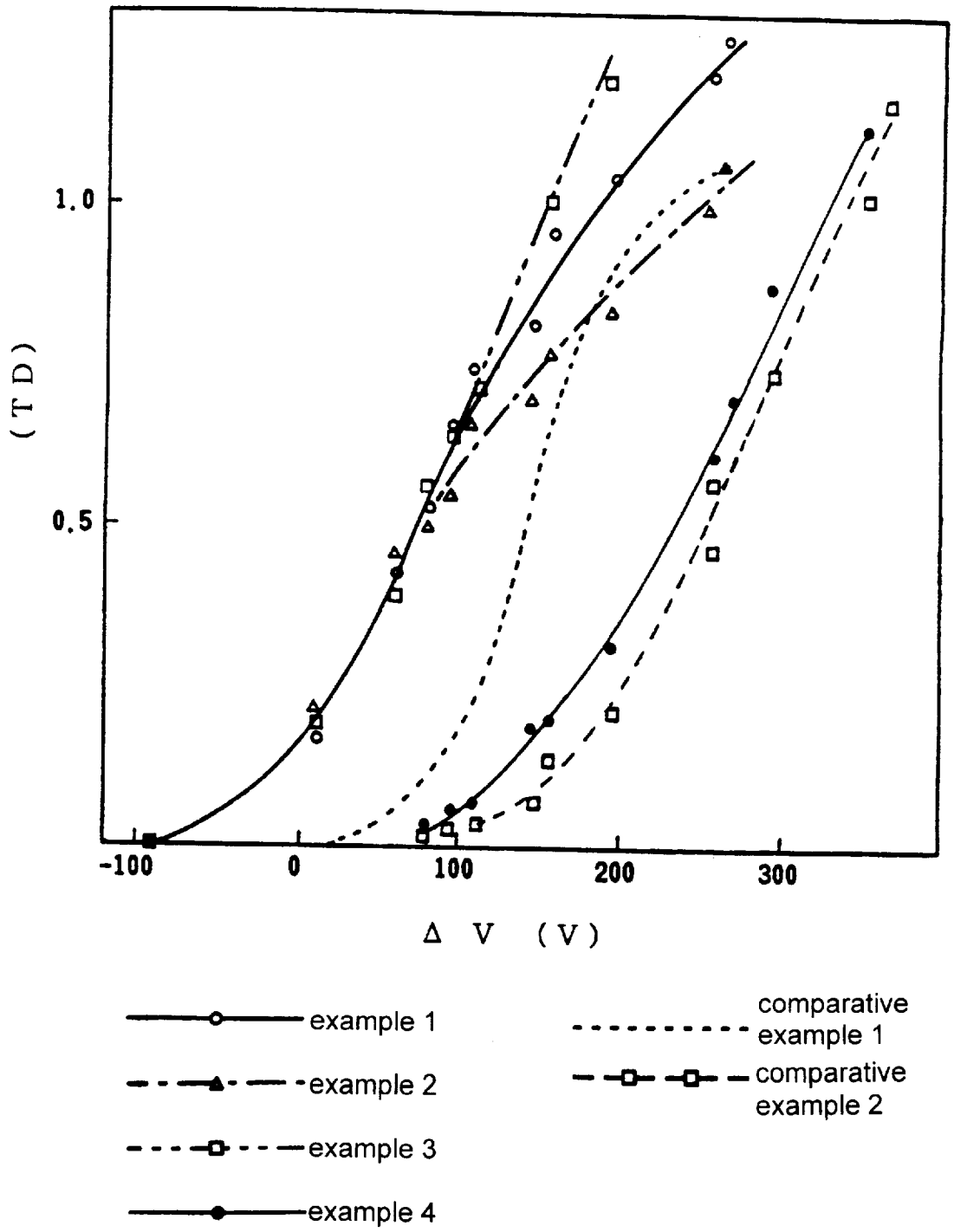
FIG. 8 is a diagram showing the relationship between the difference $\Delta V$ (=Vi−Vb) between a surface potential (Vi) on an image portion exposed in an image carrying member and an average (Vb) of voltages applied from a DC power supply and an AC power supply and the transmission density (TD) of an obtained image in a case where reversal development is performed by each of the developing apparatuses in the examples 1 to 4 and the comparative examples 1 and 2.

Reversal development was performed upon application of the above-mentioned AC voltage to each of the developing apparatuses in the examples 1 to 4 and the comparative examples 1 and 2, to examine the relationship between the difference ΔV (=Vi−Vb) between a surface potential (Vi) on an image portion exposed in the image carrying member 1 and an average (Vb) of voltages applied from the DC power supply 14 and the AC power supply 15 and the transmission density (TD) of an obtained image. The results were shown in FIG. 8.

As a result, in the developing apparatus in the comparative example 1 in which the AC electric field is continuously exerted without providing a stop period t during which no AC electric field is exerted, the change in the transmission density (TD) caused by the change in ΔV was significant in an intermediate portion of ΔV, so that a halftone image was difficult to reproduce.

On the other hand, in each of the developing apparatuses in the examples 1 to 4, the change in the transmission density (TD) caused by the change in ΔV was made more linear, and the change in the transmission density (TD) in an intermediate portion of ΔV was slighter, as compared with those in the developing apparatus in the comparative example 1. Therefore, an image superior in halftone reproduction was obtained.

Halftone images having an average image density (ID) of 0.4 were then formed using the developing apparatuses in the examples 1 to 4 and the developing apparatuses in the comparative examples 1 and 2. With respect to each of the halftone images, the density of the halftone image in a portion having an area of 10 μm×100 μm was measured for each 5 μm, and standard deviation in the halftone image is found on the basis of the results of the measurement, to show the value of the standard deviation as variation in the image density (texture). A microdensitometer (2405 Type : manufactured by Abe Sekkei K. K.) was used for measuring the image density.

As a result, the value of the standard deviation in the halftone image was 0.0456 in the developing apparatus in the example 1, 0.0454 in the developing apparatus in the example 2, 0.0457 in the developing apparatus in the example 3, and 0.0468 in the developing apparatus in the example 4, while being 0.0511 in the developing apparatus in the comparative example 1, and 0.0500 in the developing apparatus in the comparative example 2. The variation in the image density of the halftone image obtained using each of the developing apparatuses in the examples 1 to 4 was slighter, so that an image of finer texture was obtained.

EXPERIMENTAL EXAMPLE 1

In the experimental example 1, pulse voltages which have a pulse width of 0.08 ms and are the same in polarity are respectively applied to the first and last electric field portions of the AC electric field in one exertion period T in such a manner that the directions of the first and last electric field portions are the same, that is, the direction in which the developer is sent to the image carrying member 1, while a pulse voltage which has a pulse width of 0.16 ms and is opposite in polarity to the first and last pulse voltages is applied to the second electric field portion therebetween, after which a stop period t during which no AC electric field is exerted is provided, as in the above-mentioned example 1. The stop period t was changed, to change the value of T/(T+t) as shown in the following Table 1.

Reversal development was performed in the same manner as that in the above-mentioned example 1 except that the AC electric field in which the stop period t was thus changed was exerted, to examine the relationship between the difference ΔV (=Vi−Vb) between a surface potential (Vi) on an image portion and an average (Vb) of voltages applied from the DC power supply 14 and the AC power supply 15 and the image density (ID) of an obtained image. When ΔV was changed by 100 V, the ratio γ (=ΔID/100 V) of the image density (ΔID) changed in correspondence to the change was found, and halftone images having an average image density (ID) of 0.4 were formed as described above. With respect to each of the halftone images, the image density in a portion having an area of 10 μm×100 μm was measured for each 5 μm, and standard deviation in the halftone image was found on the basis of the results of the measurement, to show the value of the standard deviation as variation in the image density (texture). The results were together shown in the following Table 1.

TABLE 1

| T/(T + t) | γ(=ΔID/100V) | texture |
|---|---|---|
| 1 | 0.53 | 0.0511 |
| 0.95 | 0.52 | 0.0483 |
| 0.92 | 0.51 | 0.0469 |
| 0.90 | 0.46 | 0.0455 |
| 0.82 | 0.44 | 0.0453 |
| 0.78 | 0.43 | 0.0456 |
| 0.73 | 0.48 | 0.0455 |
| 0.70 | 0.43 | 0.0455 |
| 0.50 | 0.30 | 0.0456 |
| 0.27 | 0.27 | 0.0454 |
| 0.20 | 0.14 | 0.0454 |
| 0.11 | 0.09 | 0.0456 |

As can be seen from the results, when the value of T/(T+t) is not more than 0.90, the variation in the image density (texture) was constant at low values. When an image of fine texture is obtained, the value of T/(T+t) was preferably not more than 0.90.

The values of Vo and Vb were changed in such a manner that the difference (Vo−Vb) between an initial surface potential (Vo) of the image carrying member 1 and an average (Vb) of voltages applied from the DC power supply 14 and the AC power supply 15 is −100 V, and the value of ΔV (=Vi−Vb) was changed upon setting a surface potential (Vi) on the image portion in the range of −50 to −100 V, to perform reversal development. The amount of adhesion (mg/1000 sheets) of carrier particles to the image carrying member 1 in a case where an image was formed on 1,000 paper sheets was found. The results were shown in the following Table 2.

TABLE 2

| | ΔV (V) | | | | | | |
|---|---|---|---|---|---|---|---|
| | 200 | 400 | 600 | 800 | 1000 | 1200 | 1400 |
| amount of adhesion of carrier (mg/1000 sheets | 0.21 | 0.18 | 0.22 | 0.33 | 0.65 | 1 | 3 |

As can be seen from the results, when the value of ΔV was not less than 1000 V, the amount of adhesion of carrier particles to the image carrying member 1 was rapidly increased, so that it was impossible to perform suitable development. Therefore, development had to be performed upon setting the value of ΔV to not more than 1000 V.

In order to obtain an image having a sufficient image density (ID) of not less than 1.4 in performing development upon setting the value of ΔV to not more than 1000 V, the value of γ (=ΔID/100 V) must be not less than 0.14. As can be seen from the results shown in the foregoing Table 1, it was preferable in obtaining an image having a sufficient image density that the value of T/(T+t) was not less than 0.20.

As in the above-mentioned example 3, five pulse voltages having a pulse width of 0.16 ms are so applied that their polarities are alternately changed in one exertion period T, so that the directions of the first and last electric field portions of the AC electric field in the exertion period T are the same, that is, the direction in which the developer is sent to the image carrying member 1, after which a stop period t during which no AC electric field is exerted is provided. The stop period t was changed, to change the value of T/(T+t) as shown in the following Table 3.

Reversal development was performed in the same manner as that in the above-mentioned example 3 except that the AC electric field in which the stop period t was thus changed was exerted, to examine the relationship between the difference ΔV (=Vi−Vb) between a surface potential (Vi) on an image portion and an average (Vb) of voltages applied from the DC power supply 14 and the AC power supply 15 and the image density (ID) of the obtained image as described above. When ΔV was changed by 100 V, the ratio γ (=ΔID/I100 V) of the image density (ΔID) changed in correspondence to the change was found. The results were together shown in the following Table 3.

TABLE 3

| | | | |
|---|---|---|---|
| T/(T + t) | 0.90 | 0.54 | 0.30 |
| γ (=ΔID/100V) | 0.47 | 0.33 | 0.20 |

As a result, even when the stop period t was changed in the same AC electric field as that in the example 3, the value of δ (=ΔID/100 V) corresponding to the value of T/(T+t) was changed as in the experimental example 1. Even when the waveform of the AC electric field was changed, therefore, the same tendency as that in the above-mentioned experimental example 1 was exhibited. When the value of T/(T+t) was set to not more than 0.90, an image of finer texture was obtained. On the other hand, when the value of T/(T+t) was not less than 0.20, an image having a sufficient image density was obtained.

Second Embodiment

In a developing apparatus according to the second embodiment, in respectively applying a voltage obtained by superimposing an AC voltage on a DC voltage to the developer carrying member 11 from the DC power supply 14 and the AC power supply 15, to exert an electric field obtained by superimposing an AC electric field on a DC electric field on the developing area where the developer carrying member 11 and the image carrying member 1 are opposite to each other, an exertion period T during which an AC electric field is exerted and a stop period t during which no AC electric field is exerted are alternately repeated by the developing bias control means 16, and the AC electric field is exerted in such a manner that the directions of the first and last electric field portions of the AC electric field in one exertion period T are the same, and the direction of the last electric field portion of the AC electric field in the exertion period T and the direction of the first electric field portion of the AC electric field in the subsequent exertion period T after an elapse of the stop period t are opposite to each other.

Third Embodiment

In a developing apparatus according to the third embodiment, in respectively applying a voltage obtained by superimposing an AC voltage on a DC voltage to the developer carrying member 11 from the DC power supply 14 and the AC power supply 15, to exert an electric field obtained by superimposing an AC electric field on a DC electric field on the developing area where the developer carrying member 11 and the image carrying member 1 are opposite to each other, a stop period t during which no AC electric field is exerted is provided every time the direction of the electric field portion of the AC electric field is changed by the developing bias control means 16.

Developing apparatuses in examples 5 to 8 and comparative examples 3 to 5 in which the AC electric field exerted on the developing area where the developer carrying member 11 and the image carrying member 1 are opposite to each other is changed in the developing apparatuses according to the embodiments 2 and 3 are compared with each other are compared with each other, to make it clear that a good image is obtained if the developing apparatuses in the examples 5 to 8 are used.

Figure 9:
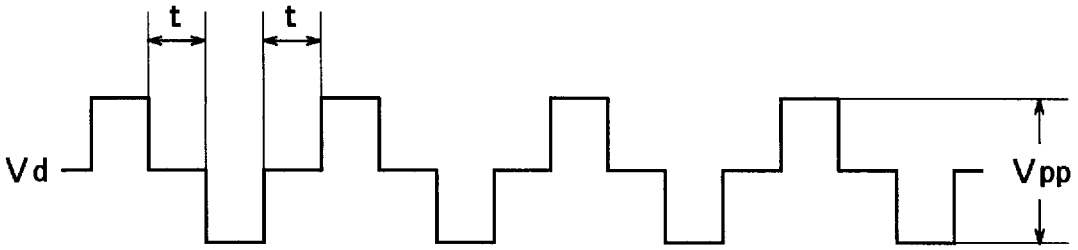
FIG. 9 is a diagram showing the state of an AC voltage applied to a developer carrying member from an AC power supply in a developing apparatus in an example 5.

In the developing apparatus in the example 5, in applying the AC voltage from the AC power supply 15, an AC voltage having a pulse width of 0.16 ms and provided with a stop period t of 0.16 ms every time the direction of the electric field portion exerted is changed is applied, as shown in FIG. 9.

Figure 10:
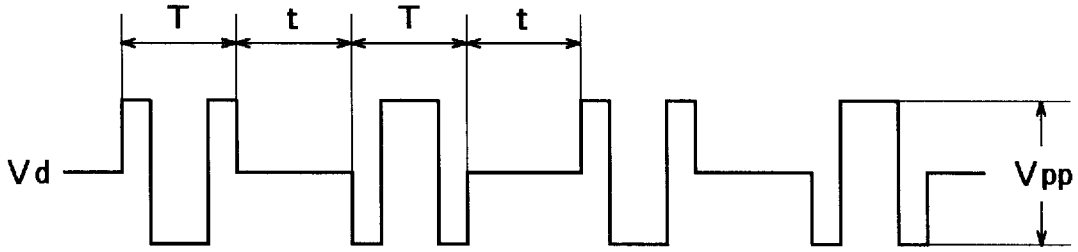
FIG. 10 is a diagram showing the state of an AC voltage applied to a developer carrying member from an AC power supply in a developing apparatus in an example 6.

In the developing apparatus in the example 6, voltages having a pulse width of 0.08 ms are respectively exerted in such a manner that the directions of the first and last electric field portions of the AC electric field are the same in one exertion period T, and a voltage which has a pulse width of 0.16 ms and is opposite in polarity to the first and last voltages is applied between the first and last voltages in such a manner that an electric field portion which is opposite in direction to the first and last electric field portions is exerted, after which a stop period t of 0.33 ms during which no AC electric field is exerted is provided, and an AC voltage which is opposite in polarity to the AC voltage in the exertion period T is applied in the subsequent exertion period T after the stop period t, as shown in FIG. 10.

Figure 11:
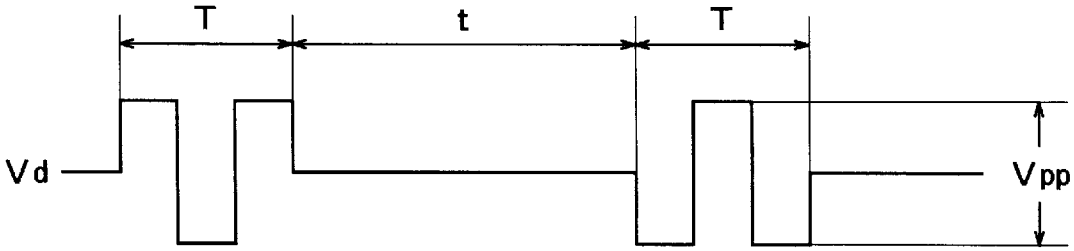
FIG. 11 is a diagram showing the state of an AC voltage applied to a developer carrying member from an AC power supply in a developing apparatus in an example 7.

In the developing apparatus in the example 7, voltages having a pulse width of 0.16 ms are respectively applied in such a manner that the directions of the first and last electric field portions of the AC electric field are the same in one exertion period T, and a voltage which has a pulse width of 0.16 ms and is opposite in polarity to the first and last voltages is applied between the first and last voltages in such a manner that an electric field portion which is opposite in direction to the first and last electric field portions is exerted, after which a stop period t of 1.0 ms during which no AC electric field is exerted is provided, and an AC voltage which is opposite in polarity to the AC voltage in the exertion period T is applied in the subsequent exertion period T after the stop period t, as shown in FIG. 11.

Figure 12:
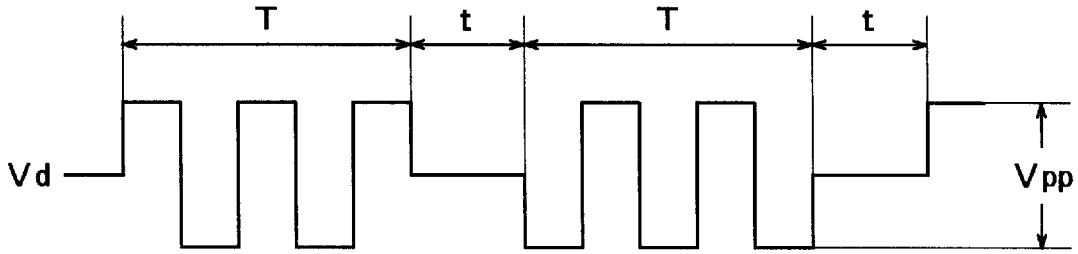
FIG. 12 is a diagram showing the state of an AC voltage applied to a developer carrying member from an AC power supply in a developing apparatus in an example 8.

In the developing apparatus in the example 8, voltages having a pulse width of 0.16 ms are respectively applied in such a manner that the directions of the first, third and last electric field portions of the AC electric field are the same in one exertion period T, and voltages which have a pulse width of 0.16 ms and are opposite in polarity to the first, third and last voltages are respectively applied to the second and fourth voltages in such a manner that an electric field portion which is opposite in direction to the first, third and last electric field portions is exerted, after which a stop period t of 0.33 ms during which no AC electric field is exerted is provided, and an AC voltage which is opposite in polarity to the AC voltage in the exertion period T is applied in the subsequent exertion period T after the stop period t, as shown in FIG. 12.

On the other hand, in the developing apparatus in the comparative example 3, an AC voltage having a pulse width of 0.16 ms is continuously applied, as shown in FIG. 6.

Figure 13:
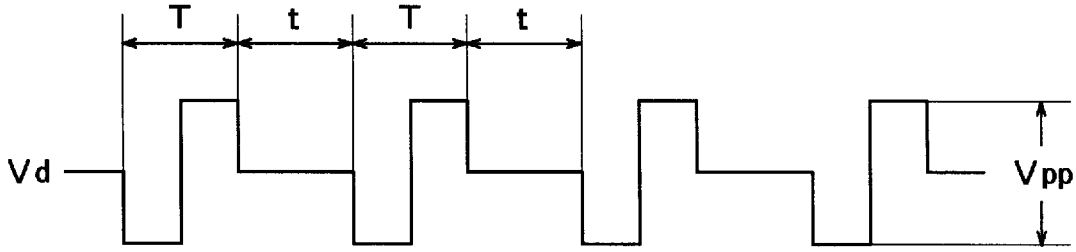
FIG. 13 is a diagram showing the state of an AC voltage applied to a developer carrying member from an AC power supply in developing apparatuses in comparative examples 4 and 7.

In the developing apparatus in the comparative example 4, a pair of voltages which have a pulse width of 0.16 ms and are opposite in polarity is applied in one exertion period T, after which a stop period t of 0.33 ms during which no AC electric field is exerted is provided, so that the direction of an electric field portion exerted by the voltage before the stop period t is always the direction in which the developer is sent to the image carrying member, as shown in FIG. 13.

In the developing apparatus in the comparative example 5, a pair of voltages which have a pulse width of 0.16 ms and are opposite in polarity is applied in one exertion period T, after which a stop period t of 0.33 ms during which no AC electric field is exerted is provided, so that the direction of an electric field portion exerted by the voltage before the stop period t is always the direction in which the developer is returned to the developer carrying member, as shown in FIG. 7.

Figure 14:
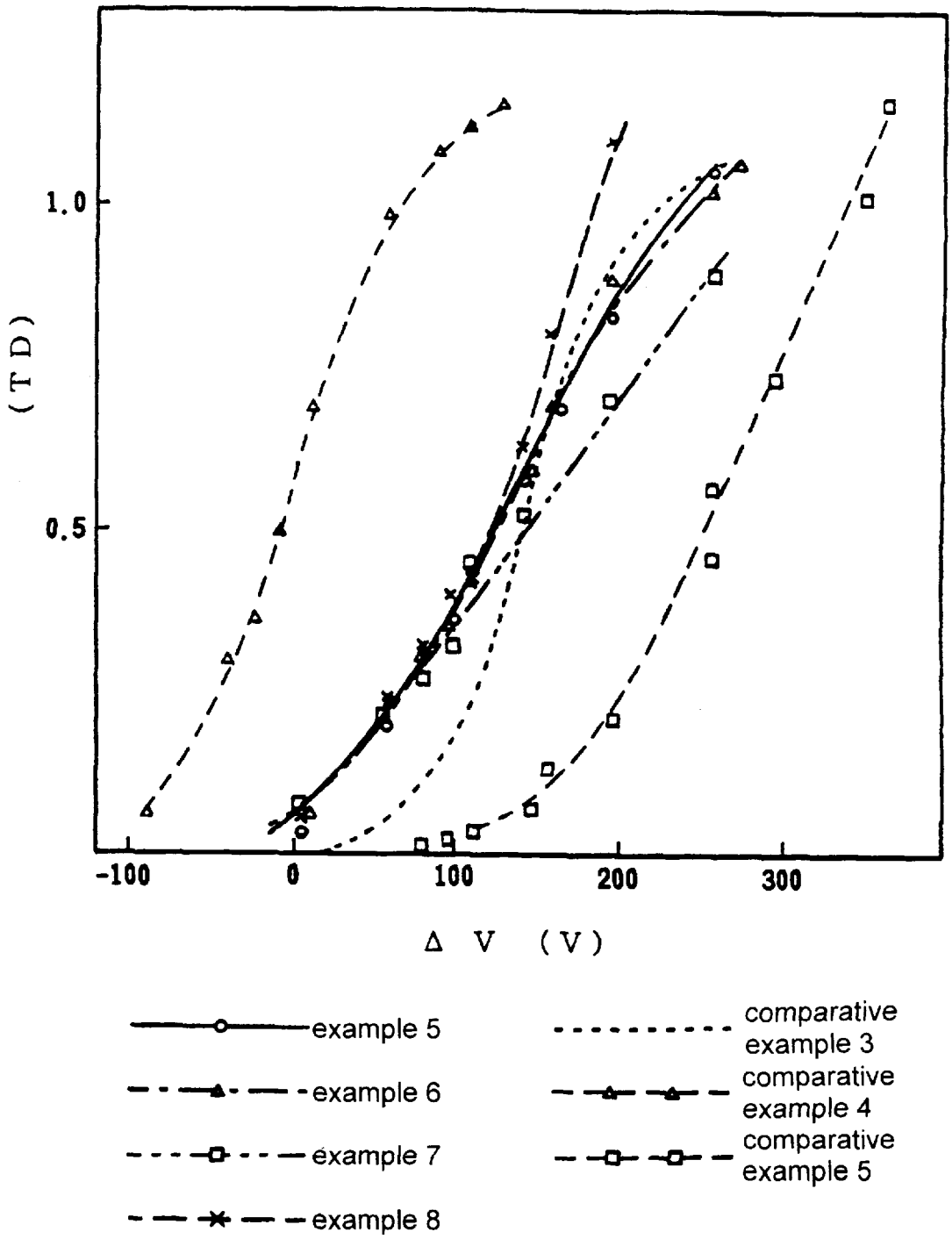
FIG. 14 is a diagram showing the relationship between the difference ΔV (=Vi−Vb) between a surface potential (Vi) on an image portion exposed in an image carrying member and an average (Vb) of voltages applied from a DC power supply and an AC power supply and the transmission density (TD) of an obtained image in a case where reversal development is performed by each of the developing apparatuses in the examples 5 to 8 and the comparative examples 3 and 5.

Reversal development was performed upon application of the above-mentioned AC voltage to each of the developing apparatuses in the examples 5 to 8 and the comparative examples 3 to 5, to examine the relationship between the difference $\Delta V$ (=Vi−Vb) between a surface potential (Vi) on an image portion exposed in the image carrying member 1 and an average (Vb) of voltages applied from the DC power supply 14 and the AC power supply 15 and the transmission density (TD) of the obtained image. The results were shown in FIG. 14.

As a result, in the developing apparatus in the comparative example 3 in which the AC electric field is continuously exerted without providing a stop period t during which no AC electric field is exerted, the change in the transmission density (TD) caused by the change in $\Delta V$ was significant in an intermediate portion of $\Delta V$, so that a halftone image was difficult to reproduce.

In the developing apparatus in the comparative example 4 in which the electric field in the direction in which the developer is sent to the image carrying member is always exerted before the stop period t, the developer was supplied too much to the image carrying member, so that the formed image was fogged. On the other hand, in the developing apparatus in the comparative example 5 in which the electric field in the direction in which the developer is returned to the developer carrying member is always exerted before the stop period t, the amount of the developer supplied to the image carrying member was conversely reduced, so that an image having a sufficient image density was not obtained.

On the other hand, in each of the developing apparatuses in the examples 5 to 8, the change in the transmission density (TD) caused by the change in $\Delta V$ was made more linear, and the change in the transmission density (TD) in an intermediate portion of $\Delta V$ was slighter, as compared with those in the developing apparatus in the comparative example 3. Therefore, an image superior in halftone reproduction was obtained, and the formed image was not fogged, so that an image having a suitable image density was obtained.

EXPERIMENTAL EXAMPLE 2

In the experimental example 2, AC voltages having a pulse width of 0.08 ms are respectively applied in such a manner that the directions of the first and last electric field portions of the AC electric field are the same in one exertion period T, and a voltage which has a pulse width of 0.16 ms and is opposite in polarity to the first and last voltages is so applied between the first and last voltages that an electric field portion which is opposite in direction to the first and last electric field portions is exerted, after which a stop period t during which no AC electric field is exerted is provided, and an AC voltage which is opposite in polarity to the AC voltage in the exertion period T is applied in the subsequent exertion period T after the stop period t, as in the developing apparatus in the example 6. The stop period t was changed, to change the value of T/(T+t) in the following Table 4.

Reversal development was performed in the same manner as that in the above-mentioned example 6 except that the AC electric field in which the stop period t was thus changed was exerted, to examine the relationship between the difference ΔV (=Vi−Vb) between a surface potential (Vi) on an image portion and an average (Vb) of voltages applied from the DC power supply 14 and the AC power supply 15 and the image density (ID) of an obtained image. When ΔV was changed by 100 V, the ratio γ (=ΔID/100 V) of the image density (ΔID) changed in correspondence to the change was found. The results were shown in the following Table 4.

Reversal development was performed in the above-mentioned manner, to form halftone images having an average image density (ID) of 0.4. With respect to each of the halftone images, the image density in a portion having an area of 10 μm×100 μm was measured for each 5 μm, and standard deviation in the halftone image was found on the basis of the results of the measurement, to show the value of the standard deviation as variation in the image density (texture). The results were together shown in the following Table 4. The image density was measured using a microdensitometer (2405 Type: manufactured by Abe Sekkei K. K.).

TABLE 4

| T/(T + t) | γ(=ΔID/100V) | texture |
|---|---|---|
| 1 | 0.53 | 0.0511 |
| 0.95 | 0.51 | 0.0496 |
| 0.92 | 0.52 | 0.0488 |
| 0.90 | 0.50 | 0.0480 |
| 0.80 | 0.47 | 0.0483 |
| 0.50 | 0.32 | 0.0481 |
| 0.20 | 0.14 | 0.0482 |
| 0.11 | 0.11 | 0.0483 |

As can be seen from the results, when the value of T/(T+t) was not more than 0.90, the variation in the image density (texture) was constant at low values. When an image of fine texture is obtained, the value of T/(T+t) was preferably not more than 0.90.

The values of Vo and Vb were changed in such a manner that the difference (Vo−Vb) between an initial surface potential (Vo) of the image carrying member 1 and an average (Vb) of voltages applied from the DC power supply 14 and the AC power supply 15 is −100 V, and the value of ΔV (=Vi−Vb) was changed upon setting a surface potential (Vi) on the image portion in the range of −50 to −100 V, to perform reversal development. The amount of adhesion (mg/1000 sheets) of carrier particles to the image carrying member 1 in a case where an image was formed on 1,000 paper sheet was found. The results were shown in the following Table 5.

TABLE 5

| | ΔV (V) | | | | | | |
|---|---|---|---|---|---|---|---|
| | 200 | 400 | 600 | 800 | 1000 | 1200 | 1400 |
| amount of adhesion of carrier (mg/1000 sheets | 0.22 | 0.21 | 0.19 | 0.34 | 0.66 | 1.1 | 3.2 |

As can be seen from the results, when the value of ΔV was not less than 1000 V, the amount of adhesion of carrier particles to the image carrying member 1 was rapidly increased, so that it was impossible to perform suitable development. Therefore, development had to be performed upon setting the value of ΔV to not more than 1000 V.

In order to obtain an image having a sufficient image density (ID) of not less than 1.4 in performing development upon setting the value of ΔV to not more than 1000 V, the value of γ (=ΔID/100 V) must be not less than 0.14. As can be seen from the results shown in the foregoing Table 4, it was preferable in obtaining an image having a sufficient image density that the value of T/(T+t) was not less than 0.20.

Also with respect to the developing apparatuses in the above-mentioned examples 5, 7 and 8, the stop period t was changed in the same manner as that in the above-mentioned experimental example 2 so that the value of T/(T+t) was 0.90 and 0.50 in the developing apparatus in the example 5, 0.80 and 0.33 in the developing apparatus in the example 7, and 0.71 and 0.40 in the developing apparatus in the example 8, as shown in the following Table 6.

Reversal development was performed in the same manner as those in the above-mentioned examples 5, 7 and 8 except that the AC electric field in which the stop period t was thus changed was exerted, to examine the relationship between the difference ΔV (=Vi−Vb) between a surface potential (Vi) on an image portion and an average (Vb) of voltages applied from the DC power supply 14 and the AC power supply 15 and the image density (ID) of the obtained image as described above. When ΔV was changed by 100 V, the ratio γ (=ΔID/100 V) of the image density (ΔID) changed in correspondence to the change was found. The results were together shown in the following Table 6.

TABLE 6

| modified example | 5 | 7 | 8 | 5 | 8 | 7 |
|---|---|---|---|---|---|---|
| T/(T + t) | 0.90 | 0.80 | 0.71 | 0.50 | 0.40 | 0.33 |
| γ(=ΔID/100V) | 0.49 | 0.45 | 0.38 | 0.30 | 0.25 | 0.18 |

As a result, even when the stop period t was changed in the developing apparatuses in the examples 5, 7, and 8, the value of γ (=ΔID/100 V) corresponding to the value of T/(T+t) was changed as in the experimental example 2 in which the stop period t was changed in the developing apparatus in the example 6. Even when the waveform of the AC electric field was changed, therefore, the same tendency as that in the above-mentioned experimental example 2 was exhibited. When the value of T/(T+t) was set to not more than 0.90, an image of finer texture was obtained. On the other hand, when the value of T/(T+t) was not less than 0.20, an image having a sufficient image density was obtained.

Fourth Embodiment

In a developing apparatus according to the fourth embodiment, in respectively applying a voltage obtained by superimposing an AC voltage on a DC voltage to the developer carrying member 11 from the DC power supply 14 and the AC power supply 15, to exert an electric field obtained by superimposing an AC electric field on a DC electric field on the developing area where the developer carrying member 11 and the image carrying member 1 are opposite to each other, an exertion period T during which an AC electric field is exerted and a stop period t during which no AC electric field is exerted are alternately repeated by the developing bias control means 16, the AC electric field is exerted in such a manner that the directions of the first and last electric field portions of the AC electric field in one exertion period T are opposite to each other, and the direction of the last electric field portion of the AC electric field in the exertion period T and the direction of the first electric field portion in the subsequent exertion period T after an elapse of the stop period t are the same, and the length of the exertion period T is set to not less than two-thirds the length of the stop period t.

Developing apparatuses in examples 9 to 11 and comparative examples 6 to 9 in which the AC electric field exerted on the developing area where the developer carrying member 11 and the image carrying member 1 are opposite to each other is changed in the developing apparatus according to the embodiment 4 are compared with each other, to make it clear that a good image is obtained if the developing apparatuses in the examples 9 to 11 are used.

Figure 15:
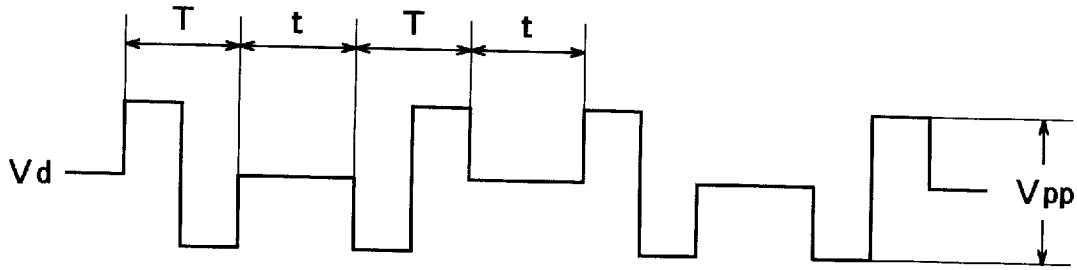
FIG. 15 is a diagram showing the state of an AC voltage applied to a developer carrying member from an AC power supply in a developing apparatus in an example 9.

In the example 9, in applying the AC voltage from the AC power supply 15, a pair of voltages which have a pulse width of 0.16 ms and are opposite in polarity is applied in one exertion period T, so that the directions of the first and last electric field portions of the AC electric field in the exertion period T are opposite to each other, after which a stop period t of 0.33 ms during which no AC electric field is exerted is provided, and an AC voltage which is opposite in direction to the AC voltage in the exertion period T is so applied in the subsequent exertion period T after the stop period t that the direction of the first electric field portion is the same as the direction of the last electric field portion in the previous exertion period T, as shown in FIG. 15. In this case, the length of the one exertion period T is set to not less than two-thirds the length of the one stop period t.

Figure 16:
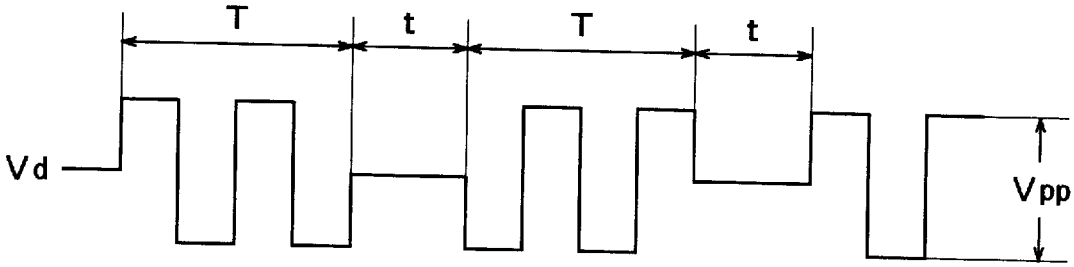
FIG. 16 is a diagram showing the state of an AC voltage applied to a developer carrying member from an AC power supply in a developing apparatus in an example 10.

In the example 10, two pairs of voltages which have a pulse width of 0.16 ms and are opposite in polarity are applied in one exertion period T, so that the directions of the first and last electric field portions of the AC electric field in the exertion period T are opposite to each other, after which a stop period t of 0.33 ms during which no AC electric field is exerted is provided, and an AC voltage which is opposite in direction to the AC voltage in the exertion period T is so applied in the subsequent exertion period T after the stop period t that the direction of the first electric field portion is the same as the direction of the last electric field portion in the previous exertion period T, as shown in FIG. 16. Also in this case, the length of the one exertion period T is set to not less than two-thirds the length of the one stop period t.

Figure 17:
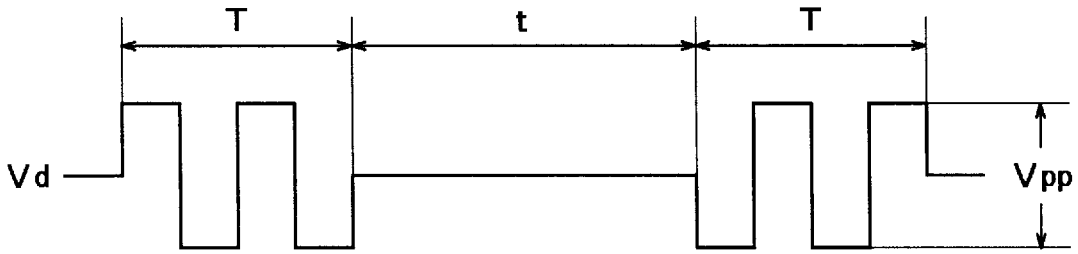
FIG. 17 is a diagram showing the state of an AC voltage applied to a developer carrying member from an AC power supply in a developing apparatus in an example 11.

In the example 11, two pairs of voltages which have a pulse width of 0.16 ms and are opposite in polarity are applied in one exertion period T, so that the directions of the first and last electric field portions of the AC electric field in the exertion period T are opposite to each other, after which a stop period t of 1.0 ms during which no AC electric field is exerted is provided, and an AC voltage which is opposite in direction to the AC voltage in the exertion period T is so applied in the subsequent exertion period T after the stop period t that the direction of the first electric field portion is the same as the direction of the last electric field portion in the previous exertion period T, as shown in FIG. 17. Also in this case, the length of the one exertion period T is set to not less than two-thirds the length of the one stop period t.

On the other hand, in the comparative example 6, an AC voltage having a pulse width of 0.16 ms is continuously applied, as shown in FIG. 6.

In the comparative example 7, a pair of voltages which have a pulse width of 0.16 ms and are opposite in polarity is applied in one exertion period T, after which a stop period t of 0.33 ms during which no AC electric field is exerted is provided, so that the direction of an electric field portion exerted by the voltage before the stop period t is always the direction in which the developer is sent to the image carrying member, as shown in FIG. 13.

In the comparative example 8, a pair of voltages which have a pulse width of 0.16 ms and are opposite in polarity is applied in one exertion period T, after which a stop period of 0.33 ms during which no AC electric field is exerted is provided, so that the direction of an electric field portion exerted by the voltage before the stop period t is always the direction in which the developer is returned to the developer carrying member, as shown in FIG. 7.

Figure 18:
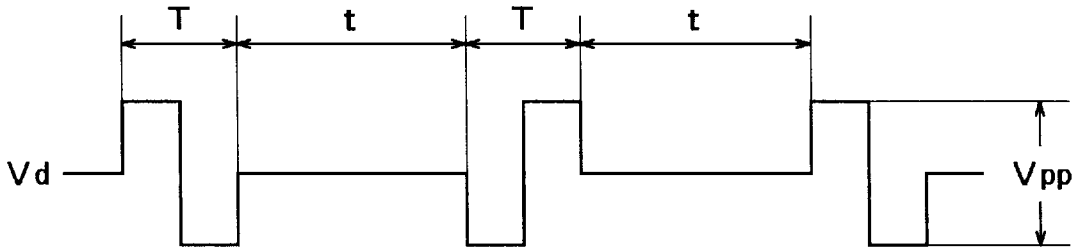
FIG. 18 is a diagram showing the state of an AC voltage applied to a developer carrying member from an AC power supply in a developing apparatus in a comparative example 9.

In the comparative example 9, a pair of voltages which have a pulse width of 0.16 ms and are opposite in polarity is applied in one exertion period T, so that the directions of the first and last electric field portions of the AC electric field in one exertion period T are opposite to each other, after which a stop period t of 0.66 ms during which no AC electric field is exerted is provided, so that the length of the exertion period T is less than two-thirds the length of the stop period t, as shown in FIG. 18. In the subsequent exertion period T after the stop period t, an AC voltage which is opposite in direction to the AC voltage in the previous exertion period T in such a manner that the direction of the first electric field portion is the same as the direction of the last electric field portion in the previous exertion period T.

Figure 19:
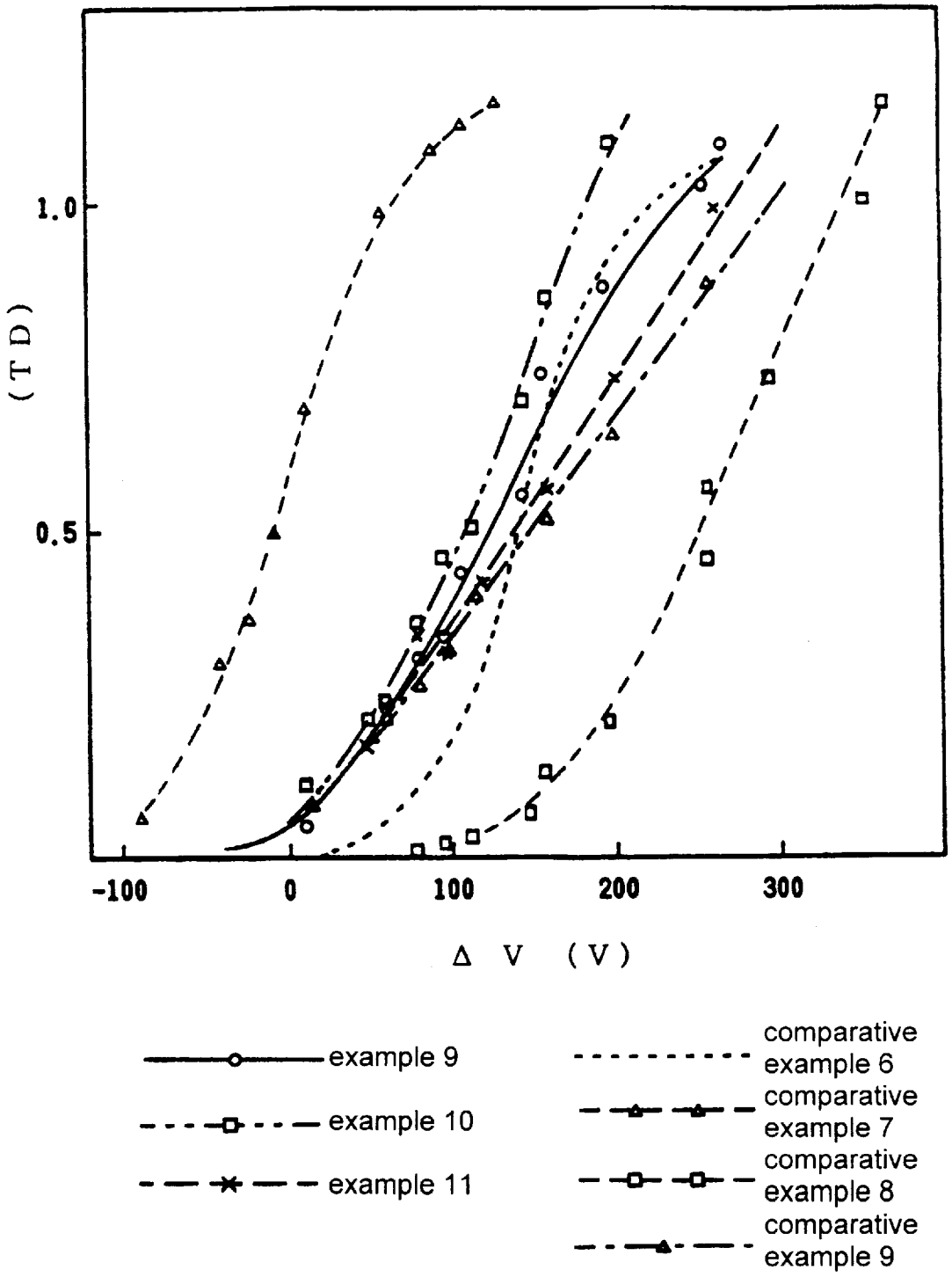
FIG. 19 is a diagram showing the relationship between the difference ΔV (=Vi−Vb) between a surface potential (Vi) on an image portion exposed in an image carrying member and an average (Vb) of voltages applied from a DC power supply and an AC power supply and the transmission density (TD) of an obtained image in a case where reversal development is performed by each of the developing apparatuses in the examples 9 to 11 and the comparative examples 6 and 9.

Reversal development was performed upon application of the above-mentioned AC voltage to each of the developing apparatuses in the examples 9 to 11 and the comparative examples 6 to 9, to examine the relationship between the difference $\Delta V$ (=Vi−Vb) between a surface potential (Vi) on an image portion exposed in the image carrying member 1 and an average (Vb) of voltages applied from the power supply 14 and the AC power supply 15 and the transmission density (TD) of the obtained image. The results were shown in FIG. 19.

As a result, in the developing apparatus in the comparative example 6 in which the AC electric field is continuously exerted without providing a stop period t during which no AC electric field is exerted, the change in the transmission density (TD) caused by the change in $\Delta V$ was significant in an intermediate portion of $\Delta V$, so that a halftone image was difficult to reproduce. In the developing apparatus in the comparative example 7 in which the electric field portion in the direction in which the developer is sent to the image carrying member is always exerted before the stop period t, the developer was supplied too much to the image carrying member, so that the formed image was fogged. On the other hand, in the developing apparatus in the comparative example 8 in which the electric field portion in the direction in which the developer is returned to the developer carrying member is always exerted before the stop period t, the amount of the developer supplied to the image carrying member was conversely reduced, so that an image having a sufficient image density was not obtained.

In the developing apparatus in the comparative example 9, the length of the exertion period T during which an AC electric field is exerted is as small as less than two-thirds the length of the stop period t during which no AC electric field is exerted, and a period during which development is performed upon exertion of the AC electric field is short. Therefore, the amount of the developer supplied to the image carrying member was reduced, whose amount was not so small as that in the developing apparatus in the comparative example 3. Even when the value of ΔV was 300 V, the transmission density (TD) was less than 1.1, so that an image having a sufficient image density was not obtained.

On the other hand, in each of the developing apparatuses in the examples 9 to 11, the change in the transmission density (TD) caused by the change in ΔV was made more linear, and the change in the transmission density (TD) in an intermediate portion of ΔV was slighter, as compared with those in the developing apparatus in the comparative example 6. Therefore, an image superior in halftone reproduction was obtained, and the formed image was not fogged. When the value of ΔV was 300 V, an image having a suitable image density, whose transmission density (TD) was not less than 1.1, was obtained.

Halftone images having an average image density (ID) of 0.4 were then formed using the developing apparatuses in the example 9 and the developing apparatus in the comparative example 6. With respect to each of the halftone images, the density of the halftone image in a portion having an area of 10 μm×100 μm was measured for each 5 μm, and standard deviation in the halftone image was found on the basis of the results of the measurement, to show the value of the standard deviation as variation in the image density (texture). A microdesitometer (2405 Type: manufactured by Abe Sekkei K. K. ) was used for measuring the image density.

As a result, the value of the standard deviation in the halftone image obtained using the developing apparatus in the example 9 was 0.0470, while the value of the standard deviation in the halftone image obtained using the developing apparatus in the comparative example 6 was 0.0511. The variation in the image density of the halftone image obtained using the developing apparatus in the example 9 was slighter, so that an image of finer texture was obtained.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. A developing apparatus for developing an electrostatic latent image formed on an image carrying member under application of a developing bias, comprising:

a developer carrying member for conveying a developer to a developing area opposite to the image carrying member with the developer held on its surface; and a developing bias in which an exertion period during which an AC electric field is exerted and a stop period during which no AC electric field is exerted are alternately repeated, a direction of a first and a last electric field portion of the AC electric field in one exertion period being the same.

2. The developing apparatus according to claim 1, wherein one exertion period (T) and one stop period (t) satisfy $0.20 \leqq T/(T+t) \leqq 0.90$.

3. The developing apparatus according to claim 1, wherein said developer is a two-component developer comprising toner particles and carrier particles, an amount of the developer conveyed to said developing area being 0.5 to 10 mg/cm$^2$.

4. The developing apparatus according to claim 1, wherein a distance (Ds) between the developer carrying member and the image carrying member in said developing area and a peak-to-peak value (Vpp) of the AC electric field satisfy $3.5\ \text{KV/mm} \leqq Vpp/Ds \leqq 5\ \text{KV/mm}$.

5. A developing apparatus for developing an electrostatic latent image formed on an image carrying member under application of a developing bias, comprising:

a developer carrying member for conveying a developer to a developing area opposite to the image carrying member with the developer held on its surface; and a developing bias in which an exertion period during which an AC electric field is exerted and a stop period during which no AC electric field is exerted are alternately repeated, a direction of a first and a last electric field portion of the AC electric field in one exertion period being the same, the direction of the last electric field portion of the AC electric field in the exertion period and the direction of the first electric field portion of the AC electric field in a subsequent exertion period after an elapse of the stop period being the same.

6. The developing apparatus according to claim 5, wherein one exertion period (T) and one stop period (t) satisfy $0.20 \leqq T/(T+t) \leqq 0.90$.

7. The developing apparatus according to claim 5, wherein said developer is a two-component developer comprising toner particles and carrier particles, a volume-average particle diameter of said carrier particles being 20 to 50 μm.

8. The developing apparatus according to claim 5, wherein said developer is a two-component developer comprising toner particles and carrier particles, an amount of the developer conveyed to said developing area being 0.5 to 10 mg/cm$^2$.

9. The developing apparatus according to claim 5, wherein a distance (Ds) between the developer carrying member and the image carrying member in said developing area and a peak-to-peak value (Vpp) of the AC electric field satisfy $3.5\ \text{KV/mm} \leqq Vpp/Ds \leqq 5\ \text{KV/mm}$.

10. The developing apparatus according to claim 9, wherein said distance Ds is 0.1 to 0.5 mm.

11. A developing apparatus for developing an electrostatic latent image formed on an image carrying member under application of a developing bias, comprising:

a developer carrying member for conveying a developer to a developing area opposite to the image carrying member with the developer held on its surface; and a developing bias in which an exertion period during which an AC electric field is exerted and a stop period during which no AC electric field is exerted are alternately repeated, a direction of a first and a last electric field portion of the AC electric field in one exertion period being the same, the direction of the last electric field portion of the AC electric field in the exertion period and the direction of the first electric field portion of the AC electric field in a subsequent exertion period after an elapse of the stop period being opposite to each other.

12. The developing apparatus according to claim 11, wherein one exertion period (T) and one stop period (t) satisfy $0.20 \leqq T/(T+t) \leqq 0.90$.

13. The developing apparatus according to claim 11, wherein said developer is a two-component developer comprising toner particles and carrier particles, an amount of the developer conveyed to said developing area being 0.5 to 10 mg/cm$^2$.

14. The developing apparatus according to claim 11, wherein a distance (Ds) between the developer carrying member and the image carrying member in said developing area and a peak-to-peak value (Vpp) of the AC electric field satisfy 3.5 KV/mm $\leqq$ Vpp/Ds $\leqq$ 5 KV/mm.

15. A developing apparatus for developing an electrostatic latent image formed on an image carrying member under application of a developing bias, comprising:

a developer carrying member for conveying a developer to a developing area opposite to the image carrying member with the developer held on its surface; and a developing bias having a stop period during which no AC electric field is exerted every time a direction of an electric field portion of the AC electric field is changed.

16. The developing apparatus according to claim 15, wherein one exertion period (T) and one stop period (t) satisfy $0.20 \leqq T/(T+t) \leqq 0.90$.

17. A developing apparatus for developing an electrostatic latent image formed on an image carrying member under application of a developing bias, comprising:

a developer carrying member for conveying a developer to a developing area opposite to the image carrying member with the developer held on its surface; and a developing bias in which an exertion period during which an AC electric field is exerted and a stop period during which no AC electric field is exerted are alternately repeated, a direction of a first and a last electric field portion of the AC electric field in one exertion period being opposite to each other, the direction of the last electric field portion of the AC electric field in the exertion period and the direction of the first electric field portion of the AC electric field in a subsequent exertion period after an elapse of the stop period being the same.

18. The developing apparatus according to claim 17, wherein one exertion period (T) and one stop period (t) satisfy $T \geqq 2/3t$.

19. The developing apparatus according to claim 17, wherein said developer is a two-component developer comprising toner particles and carrier particles, an amount of the developer conveyed to said developing area being 0.5 to 10 mg/cm$^2$.

20. The developing apparatus according to claim 17, wherein a distance (Ds) between the developer carrying member and the image carrying member in said developing area and a peak-to-peak value (Vpp) of the AC electric field satisfy 3.5 KV/mm $\leqq$ Vpp/Ds $\leqq$ 5 KV/mm.

21. A developing apparatus for developing an electrostatic latent image formed on an image carrying member under application of a developing bias, comprising:

a developer carrying member for conveying a developer to a developing area opposite to the image carrying member with the developer held on its surface;

developing bias applying means for applying a developing bias between the developer carrying member and the image carrying member; and developing bias control means for so controlling the developing bias that an exertion period during which an AC electric field is exerted and a stop period during which no AC electric field is exerted are alternately repeated, a direction of a first and a last electric in field portion of the AC electric field in one exertion period are the same, and the direction of the last electric field portion of the AC electric field in the exertion period and the direction of the first electric field portion of the AC electric field in a subsequent exertion period after an elapse of the stop period are the same.

22. The developing apparatus according to claim 21, wherein one exertion period (T) and one stop period (t) satisfy $0.20 \leqq T/(T+t) \leqq 0.90$.

23. The developing apparatus according to claim 21, wherein said developer is a two-component developer comprising toner particles and carrier particles, a volume-average particle diameter of said carrier particles being 20 to 50 $\mu$m.

24. The developing apparatus according to claim 21, wherein said developer is a two-component developer comprising toner particles and carrier particles, an amount of the developer conveyed to said developing area being 0.5 to 10 mg/cm$^2$.

25. The developing apparatus according to claim 21, wherein a distance (Ds) between the developer carrying member and the image carrying member in said developing area and a peak-to-peak value (Vpp) of the AC electric field satisfy 3.5 KV/mm $\leqq$ Vpp/Ds $\leqq$ 5 KV/mm.

* * * * *